US006854230B2

(12) United States Patent
Starke

(10) Patent No.: US 6,854,230 B2
(45) Date of Patent: Feb. 15, 2005

(54) CONTINUOUS STRUCTURAL WALL SYSTEM

(76) Inventor: Charles Starke, 47 Hawksbrow Drive N.W., Calgary, Alberta (CA), T3G 3B4

( * ) Notice: Subject to any disclaimer, the term of this patent is extended or adjusted under 35 U.S.C. 154(b) by 0 days.

(21) Appl. No.: 10/386,697

(22) Filed: Mar. 13, 2003

(65) Prior Publication Data

US 2004/0177581 A1 Sep. 16, 2004

(51) Int. Cl.[7] ..... E04C 2/34
(52) U.S. Cl. ..... 52/481.1; 52/241; 52/483.1
(58) Field of Search ..... 52/481.1, 479, 52/394.1, 407.1, 241, 242, 220.7, 483.1

(56) References Cited

U.S. PATENT DOCUMENTS 3,001,615 A * 9/1961 Ries ..... 403/230
3,217,452 A * 11/1965 Steele ..... 52/242
3,712,004 A 1/1973 Loebsack
3,958,372 A * 5/1976 Benbow ..... 52/36.6
3,999,343 A * 12/1976 Roberts ..... 52/241
4,068,434 A 1/1978 Day et al.
4,147,004 A 4/1979 Day et al.
4,163,349 A * 8/1979 Smith ..... 52/241
4,330,921 A 5/1982 White, Jr.
4,370,838 A * 2/1983 Vermillion ..... 52/36.6
4,578,909 A 4/1986 Henley et al.
4,628,650 A 12/1986 Parker
4,641,468 A 2/1987 Slater
4,674,253 A 6/1987 Young
4,712,352 A 12/1987 Low
4,765,105 A 8/1988 Tissington et al.
4,841,710 A 6/1989 Considine
4,896,469 A * 1/1990 Wright ..... 52/220.2
5,067,296 A 11/1991 Brown et al.
5,072,569 A 12/1991 Vantassel
5,081,810 A 1/1992 Emmert
5,127,760 A * 7/1992 Brady ..... 403/230
5,279,089 A 1/1994 Gulur
5,349,796 A 9/1994 Meyerson
5,497,589 A 3/1996 Porter
5,628,158 A 5/1997 Porter
5,638,651 A 6/1997 Ford
5,701,708 A 12/1997 Taraba et al.
5,722,198 A 3/1998 Bader
5,724,779 A * 3/1998 Chang ..... 52/239
5,765,330 A 6/1998 Richard
5,787,651 A * 8/1998 Horn et al. ..... 52/144
5,787,665 A 8/1998 Carlin et al.
5,822,940 A 10/1998 Carlin et al.
5,899,037 A 5/1999 Josey
6,164,035 A 12/2000 Roberts
6,189,269 B1 * 2/2001 De Zen ..... 52/220.5
6,195,950 B1 3/2001 Harris
6,393,783 B2 5/2002 Emaus et al.
2003/0196401 A1 * 10/2003 Surowiecki ..... 52/481.2

OTHER PUBLICATIONS www.plastifab.com/sips/02spec.html, Aug. 20, 2002, 2 pages.
www.ccbfc.org/irc/newsletter/v2no1/panels.html, Aug. 20, 2002, 2 pages.

* cited by examiner

*Primary Examiner*—Anita M. King
(74) *Attorney, Agent, or Firm*—Sean W. Goodwin; Linda M. Thompson

(57) ABSTRACT

A composite wall panel having continuous upper and lower hollow horizontal chases and spaced hollow vertical chases formed throughout the panel to permit passage of electrical wiring and the like. The chases have protective barriers to protect the wiring from penetration and damage due to mechanical fasteners used to manufacture the panel and to construct load bearing walls using a plurality of manufactured panels. Further, the panel has a continuous header to provide structural rigidity and to permit rapid manufacturing of the panel without the need to frame openings, such as doors and windows, at the time of manufacture. Openings are cut in the panels and finished after the walls are constructed.

24 Claims, 6 Drawing Sheets

CONTINUOUS STRUCTURAL WALL SYSTEM

FIELD OF THE INVENTION

The present invention relates to composite wall systems for modular construction. More particularly the invention relates to formation of chases for services, vertically and horizontally, within the structural elements of the wall system.

BACKGROUND OF THE INVENTION

Conventional wisdom in construction techniques has been to remain with tried, tested and true materials and methodologies. Accordingly, conventional wall frame construction continues to utilize either 2"×4" or 2"×6" construction in either a stick framing or a unit framing technique. Additionally, stressed-skin panels have been introduced in which two sheets of building material are sandwiched together about a foam core to provide insulation.

In stick frame construction, a wall is generally built in place, using a framework of repeating, evenly spaced wall studs. At openings, such as windows and doors, a custom framework is constructed, including a lintel over the opening, to ensure structural integrity above and across any openings.

In unit framing construction, a wall structure, including lintels and frames about predetermined openings, is built as a complete unit on a pre-constructed floor structure and the unit is then erected into place by standing it up and fastening it, at a base, to the floor.

In stressed skin construction, individual panels are laid out at the construction site. The structure comprises an assembly of panels which can be cut or stacked to whatever height is required. Typically, panels are available as 4'×8' or 3'×8' panels. Most often, conventional construction utilizes panels in 4' lengths by 8' heights. The panels are manufactured having a variety of thicknesses of insulation core, depending upon the desired degree of insulation, creating panels that are the equivalent of conventional 2"×4" or 2"×6" beam lumber.

Using any of the aforementioned conventional techniques requires skilled laborers, sophisticated equipment and considerable time to assemble and erect a structure.

Modular systems exist which attempt to overcome the problems related to conventional construction techniques. One such system is disclosed in U.S. Pat. No. 4,068,434 to Day et al. which utilizes wall panels having inner and outer skins or wood sheeting material adhesively bonded on opposite sides of a core of rigid expanded foam material. An integral, horizontal beam having greater vertical height than width is adhesively bonded horizontally at the top of the wall unit from one end of the wall to the other to provide structural rigidity. In one alternate embodiment, Day provides a plurality of vertical wood furring strips which are adhesively bonded to the inner facing of the wall unit for strengthening the wall and to provide an air space between the wall and finishing panels. Periodic notches are formed across the furring strips for passing wiring. In essence, Day's wall panel utilizes a first structural wall panel, bonded together with adhesives and having a second false wall forming an air gap and wiring access. The structure of Day's panels requires that the wiring be installed before the finishing, typically drywall or sheetrock, is applied. If wiring is not installed prior to installation, subsequent fishing of wiring through the sheeted panel is unsupported and unguided either horizontally through notches between the furring strips or vertically in the spaces created between the furring strips.

The use of adhesively assembled wall panels has not yet been approved under many building codes. In Canada, Canada Mortgage and Housing Corporation (CMHC) negatively views the use of any laminates or adhesive bonding that are exposed to the environment. Specifically, known disadvantages of adhesive bonding include de-lamination of the bond when exposed to the elements. It is uncertain how long the bond will hold and thus CMHC believes that it is risky to use where structural integrity is required for an extended time.

U.S. Pat. No. 5,822,940 to Carlin et al. teaches a composite wall panel having a polymer foam core, sandwiched by opposing wall surfaces and having at least one light metal gauge hollow stud in the body of the wall, the foam extending into the center of the stud to secure the stud to the body. No provision is made in the panel for electrical services. Wiring can be passed through holes in the metal studs to extend vertically through the panel, however, the insulation must be removed to permit wiring to extend horizontally through the panel. Open channels at the top and bottom of the wall panel are utilized for affixing the panel to the floor and to the roof and as such are compromised by fasteners extending through the channels making them incompatible with standard electrical wiring. Armor jacketed cable that is impervious to fasteners is required, which adds to the overall expense and man hours required.

U.S. Pat. No. 5,701,708 to Taraba et al. teaches a structural foam core panel with a built-in header. While providing load carrying support above openings formed in the panel, the header does not provide a passage for electrical services and the like. Passages must be grooved in the insulation prior to sheeting in order to pass wiring therethrough.

There is a demonstrated need to provide a modular wall system having readily accessible conduits for providing services integrated within the structural elements of the wall, the services being protected from mechanical fastening means extending into the structural elements during construction. Further, the wall should be easily installed and affixed to adjacent walls, floors and roof members so as to provide a system for construction that requires a minimum of skill, time and equipment.

SUMMARY OF THE INVENTION

A composite panel incorporates a horizontally extending hollow load bearing header having hollow studs spaced at intervals throughout the width of the panel. The hollow header and hollow studs form horizontal and vertical chases for accommodating utilities such as wiring, cabling and conduit. Holes are formed in the horizontal chase coincident with the vertical chases to permit communication therebetween. The utilities are protected from damage as a result of penetration by mechanical fasteners used to assemble the panels into wall structures. Protective barrier members are positioned within the hollow chases, leaving a core open for the passage of the utilities. Further, the header provides structural rigidity and enables one to provide door and window penetrations substantially anywhere in the wall.

The panel is insulated between the spaced studs and has sheeting material affixed on opposing sides. An external layer of sheeting material is affixed with mechanical fasteners to provide sufficient structural integrity to withstand exposure to the elements. An interior layer of sheeting can be mechanically fastened or can be affixed using adhesive.

Preferably, an inner surface of the interior layer of sheeting is finished with a layer of finishing material such as drywall or paper which acts as an air barrier and an aesthetic finish.

Preferably, the base of the panel further comprises a second hollow horizontal chase and the chase is similarly protected by protective barrier members. More preferably, the second hollow chase is formed by a downward facing U-shaped wall base fitting attached to a bottom of the panel which cooperates with an upward facing U-shaped base plate which is adapted for attachment to a floor structure.

Panels of the invention are used to form load bearing wall structures. Particularly, panels are provided with nailing strips as a result of sheeting material extending beyond a width of the panel. The nailing strip can be removed from a first panel which is placed perpendicular to the nailing strip of a second panel for forming a corner.

In the broadest aspect of the invention a composite wall panel comprises: a base extending horizontally at a bottom of the panel and adapted for attachment to a floor structure; a continuous hollow header extending horizontally at a top of the panel, the hollow header defining an upper horizontally extending chase for passage of services therethrough; a plurality of vertically extending, hollow studs spaced at intervals intermediate a length of the panel so as to space the base from the header for forming a frame, the hollow studs defining a plurality of vertically extending chases for communication with the upper horizontally extending chase; insulating material positioned intermediate the spaced studs; and opposing layers of sheeting material affixed to opposing surfaces of the frame, at least one of which is affixed to the studs using mechanical fasteners, wherein the vertical studs are fitted with protective barrier members to prevent protrusion of the mechanical fasteners into the vertical chase.

DETAILED DESCRIPTION OF THE PREFERRED EMBODIMENT

Figure 1:
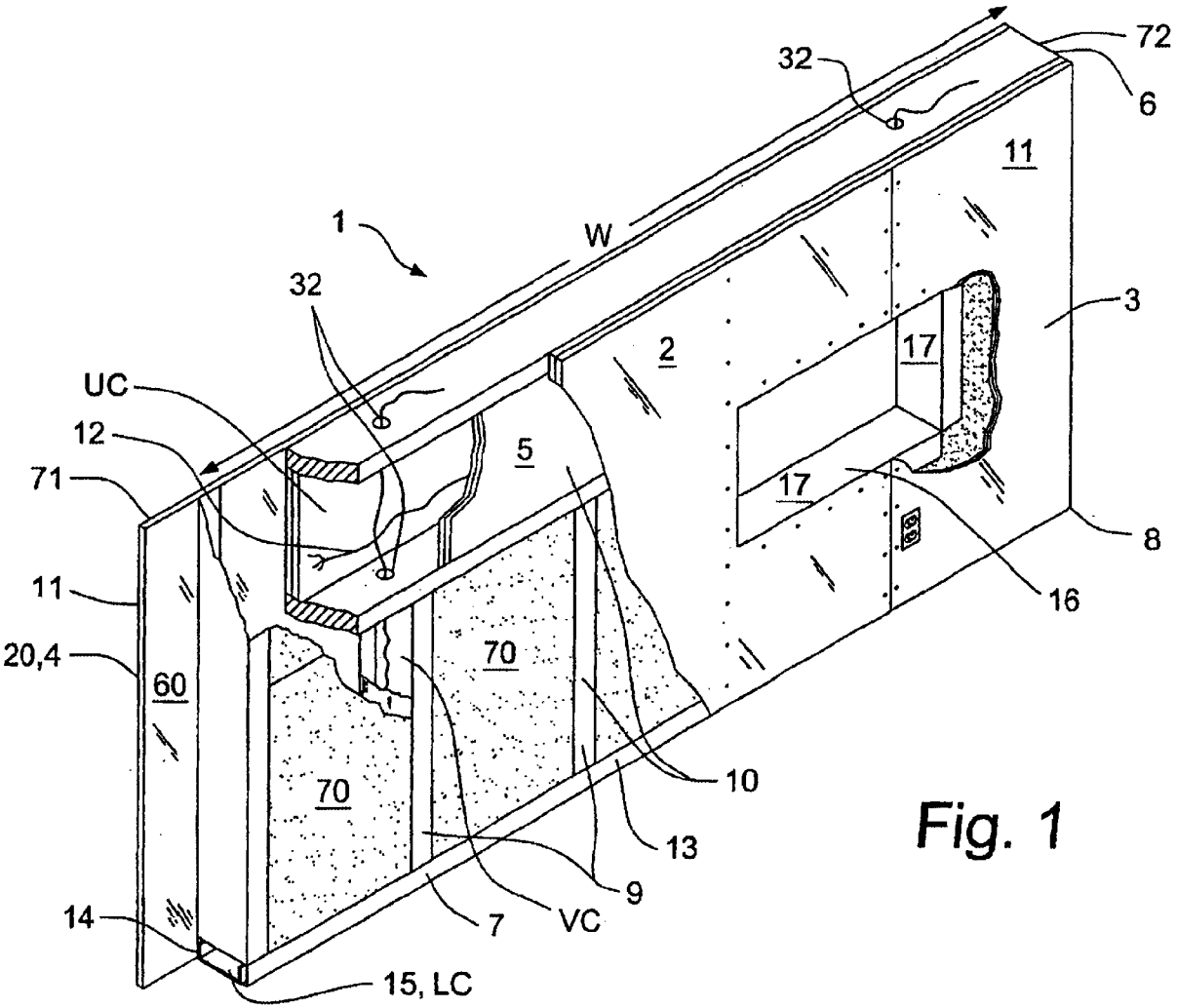
FIG. 1 is a partially cutaway perspective view of a wall panel of the present invention.
Figure 2:
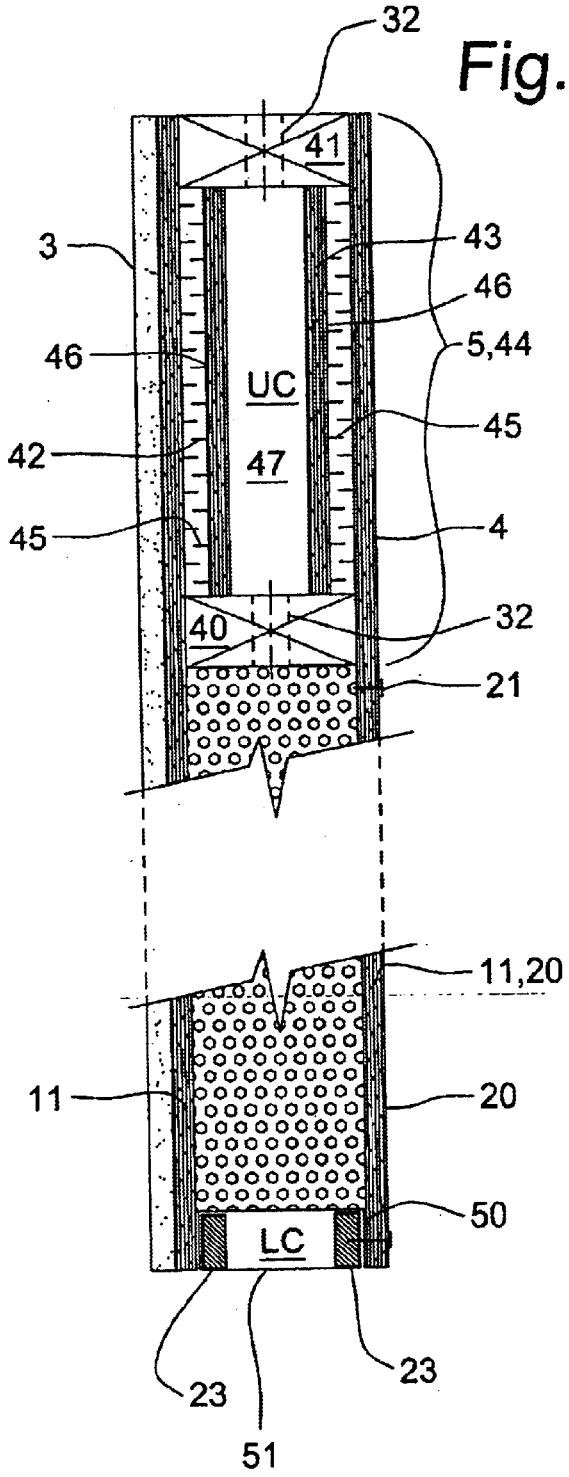
FIG. 2 is a partial cross-sectional view of the wall panel illustrating a portion of the wall containing the upper chase and a portion of the panel containing the lower chase according to FIG. 1.
Figure 3:
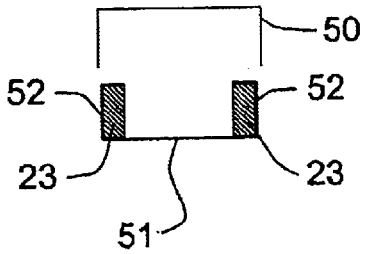
FIG. 3 is a cross-sectional view of a base plate and a wall base fitting according to FIG. 1.

As shown in FIGS. 1–3, a composite wall panel 1 is used to form at least a portion of a substantially rectangular structural wall 2 having opposing planar surfaces 3, 4, one of which may be exposed to the environment. The panel 1 comprises a hollow header 5 formed horizontally across a top 6 of the panel 1 and a base 7 formed horizontally across a bottom 8 of the panel 1 for attaching to an existing floor structure (not shown). The hollow header 5 is spaced from the base 6 by a plurality of hollow studs 9 positioned at intervals intermediate a width "w" of the panel, forming a frame 10. Sheeting material 11 is affixed to the frame 10 on the opposing planer surfaces 3,4 for forming the panel 1. Once sheeted, the panel 1 has limited access therein for the installation of utilities 12 such as wire, cabling and conduit. The hollow header 5 and studs 9 form vertical chases "VC" and an upper horizontal chase "UC" which can communicate with each other so as to enable ready installation of the utilities 12 throughout the panel 1. Optionally, a wall base fitting 13 in combination with a complementary base plate 14, can used to form a hollow base 15 to be employed as a second and lower horizontal chase "LC", at the bottom 8 of the panel, for interconnection with the vertical chases "VC" in the studs 9.

When used to form an external wall 2 of a structure, at least an external planer surface 20 of the wall 2 is exposed to the environment and therefore sheeting material 11 is affixed using mechanical fasteners 21, thus ensuring long term integrity of the wall 2. Mechanical fasteners 21 are prevented from interfering with utilities 12 which are routed through the hollow portions 22 of each vertical chase "VC" by a protective barrier member 23 positioned in each vertical chase "VC" adjacent at least the external planar surface 20 of the wall 2.

Figure 4:
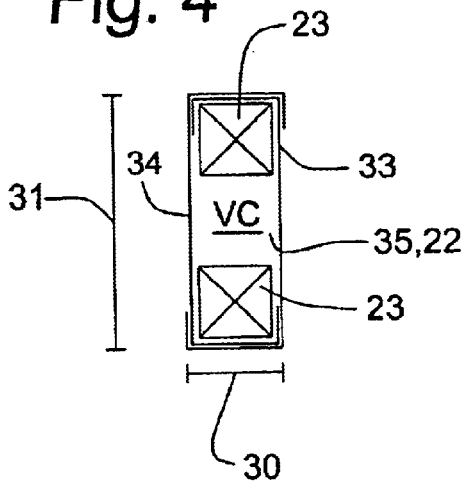
FIG. 4 is a cross-sectional view of a hollow stud according to FIG. 1.

In greater detail, as shown in FIG. 4, the studs 9 are hollow, creating vertical chases "VC" to permit passing electrical wiring 12 and the like therethrough. The studs 9 are typically rectangular having a width portion 30 narrower than a depth 31, the planar surfaces 3,4 of the wall 2 being attached to opposing narrower width portions 30 of the stud 9.

As shown in FIG. 1, openings 32 are drilled in the upper horizontal chase "UC", coincident with hollow centers of the studs 9, when required to permit communication between the vertical chase "VC" in the stud 9 and the upper horizontal chase "UC" for running electrical wiring and the like. Similarly, if a hollow lower horizontal chase "LC" is formed, communicating openings may be drilled in the lower chase "LC" as well.

More particularly, the hollow studs 9 are formed of two vertically extending shaped members 33,34 which interlock to define a hollow core 35 while providing structural rigidity. One form of shaped members 33,34 are cooperating shapes of the same profile which interlock when mated with mirrored shaped members 33,34.

A protective barrier member 23 is positioned inside the hollow core 35 of each stud 9 adjacent at least one of the narrow width portions 30 of the stud 9 adjacent the planar surfaces 3,4. The protective barrier member 23 is a vertically extending length of material, preferably polystyrene insulation, which is sized so as to fit the narrow width portion 30 of the stud 9 while leaving the remainder of the core 35 open for passage of wiring and the like, as shown in FIG. 4. Placement of the barrier member 23 provides protection for services 12 passing through the stud 9 from the intrusive mechanical fasteners 21 used to attach sheeting material 11 and the like to the frame 10.

Having reference again to FIGS. 1 and 2, the hollow header 5 is a continuous hollow composite header formed atop the hollow studs 9 and extending horizontally substantially the entire width w of the panel 1 to add structural rigidity, load bearing capability, as well as providing the upper horizontal chase "UC" for accommodating electrical wiring and the like. The continuous header 5 also permits panels 1 to be formed having a greater width than height, allowing structures to be built using a minimum number of panels 1 and preferably built using a single panel 1 to form a wall 2. Openings 16 for windows and doors can be formed in the panel 1 after manufacturing, as a result of the strength provided by the continuous header 5, thus allowing rapid and efficient constructions of the panels 1 without the need to plan openings at the time of manufacture. Preferably, a nailing strip 17 is added around the openings 16 to maintain the integrity of the wall panel 1 once the openings are cut. More preferably, the nailing strips 17 are formed of U-shaped cap material 73, described later.

As shown in FIG. 2, the header 5 is comprised of a bottom rail 40 and a top rail 41. The rails 40,41 are vertically spaced apart from one another in parallel arrangement by horizontally extending and laterally opposing spacing members 42,43 positioned therebetween, thus forming a rectangular hollow beam 44 having a hollow core 47. Preferably, the bottom and top rails 40,41 are wood and the opposing spacing members 42,43 are sheeting material 11. More preferably the spacing members 42,43 are offset inwardly so that a layer of insulation 45, such as polystyrene or polyurethane, is affixed to outward facing surfaces 46 of the opposing spacing members 42,43 for providing insulation about the hollow core 47 of the header 5. Holes 32, as shown in FIG. 1, are drilled in the bottom rail 41 of the header 5, coincident to the core 35 of the studs 9, when required, to permit communication between the upper horizontal chase "UC" in the header 5 and the vertical chases "VC" in the studs 9.

Having reference again to FIGS. 1–3 and in another embodiment of the invention, the panel 1 has a hollow lower horizontal chase "LC" formed at the bottom 8 of the panel 1. Best seen in FIG. 3, a downward facing U-shaped wall base fitting 50 is attached to the bottom 8 of the panel 1 for forming the base 7 of the panel 1. The panel 1 is supported on the existing floor (not shown) by placing the U-shaped wall base fitting 50 over an upward facing U-shaped base plate 51, attached to a floor surface. The combined U-shaped wall base fitting 50 and U-shaped base plate 51 form the rectangular hollow lower horizontal chase "LC". At least one vertical edge 52 of the lower horizontal chase "LC" is fitted with a horizontally extending protective barrier member, preferably polystyrene or polyurethane insulation, to protect the wiring and the like from damage caused by protruding mechanical fasteners used to affix sheeting to at least one of the planar surfaces of the panel.

Preferably, the U-shaped base plate 51 and wall base fitting 50 are made of metal.

The sheeting material 11 attached to opposing planar surfaces 3,4 of the frame 10 is typically available in 4'×8" sheets and is fastened to the studs 9, using either mechanical fasteners 21, such as screws, or an adhesive. If the surface 3,4 is to be exposed to the elements, such as an external wall surface 20, the sheeting 11 is affixed using mechanical fasteners 21 and the studs 9 and lower horizontal chase "LC" are appropriately fitted with protective barrier members 23, as previously described. The sheeting material 11 is attached to extend vertically sufficient to cover the U shaped wall base fitting 50 at the bottom 8 of the wall 2 and the header 5 at the top 6 of the wall 2. Further, as shown in FIGS. 1,5 and 6, the external layer 20 of sheeting material 11 is permitted to extend beyond the width w of the panel 1 creating a nailing strip 60 to facilitate assembly to an adjacent panel 1*a* to create a corner 61 of a structure 62.

Rigid foam insulation 70, such as polystyrene or polyurethane insulation, is sandwiched between the opposing layers 3,4 of sheeting material 11 and from the header 5 to the lower horizontal chase "LC "to act as a vapor barrier. Poly-sheeting may be added, where required by code, to further act as a vapor barrier. As shown in FIG. 5. at opposing ends 71,72 of the wall 2, a vertically extending U-shaped cap member 73 is positioned about an end 74 of the insulation 70 to sandwich the insulation 70 between the cap 73 and an adjacent stud 9.

Figure 5:
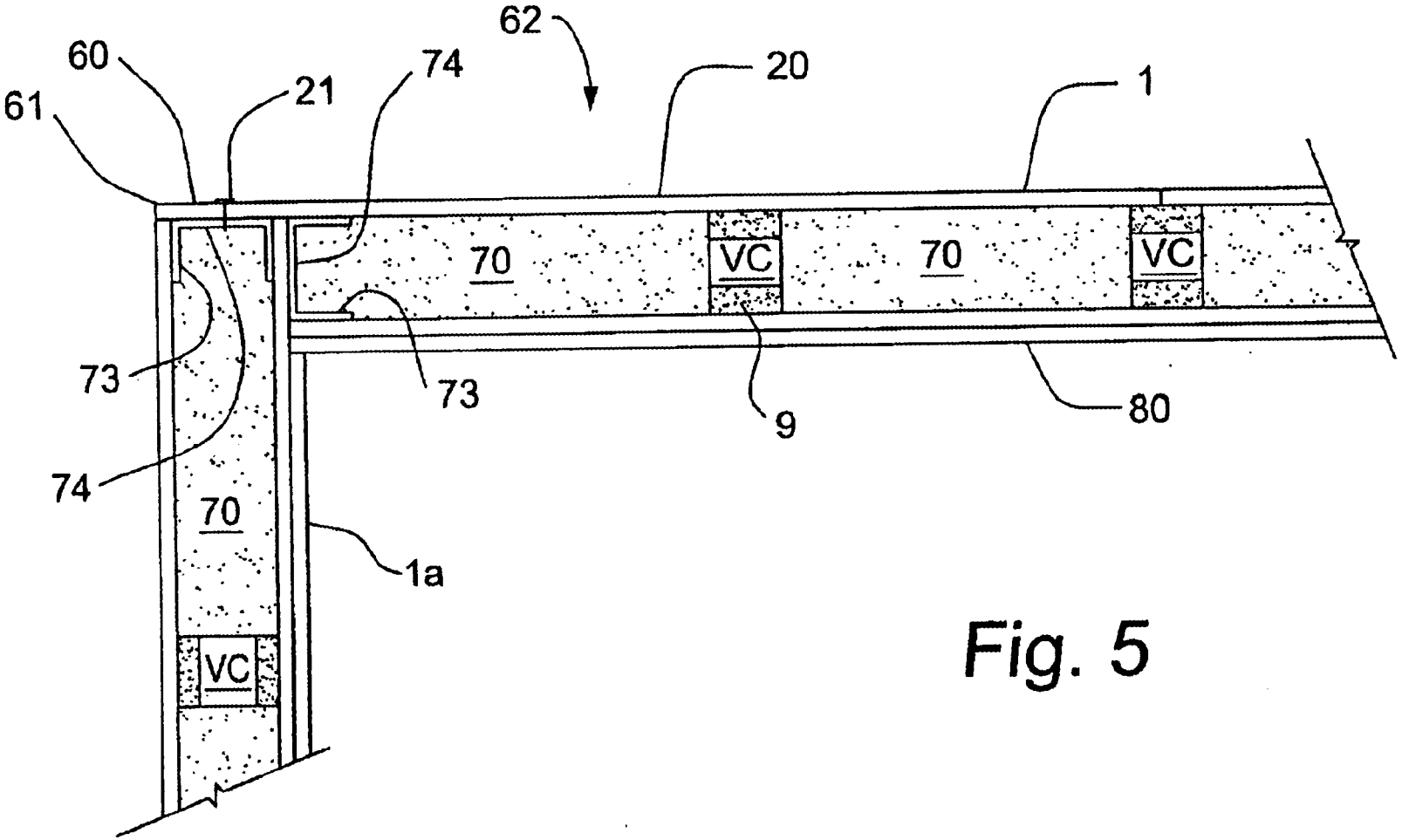
FIG. 5 is a plan view of adjacent walls of the structure according to FIG. 5.
Figure 6:
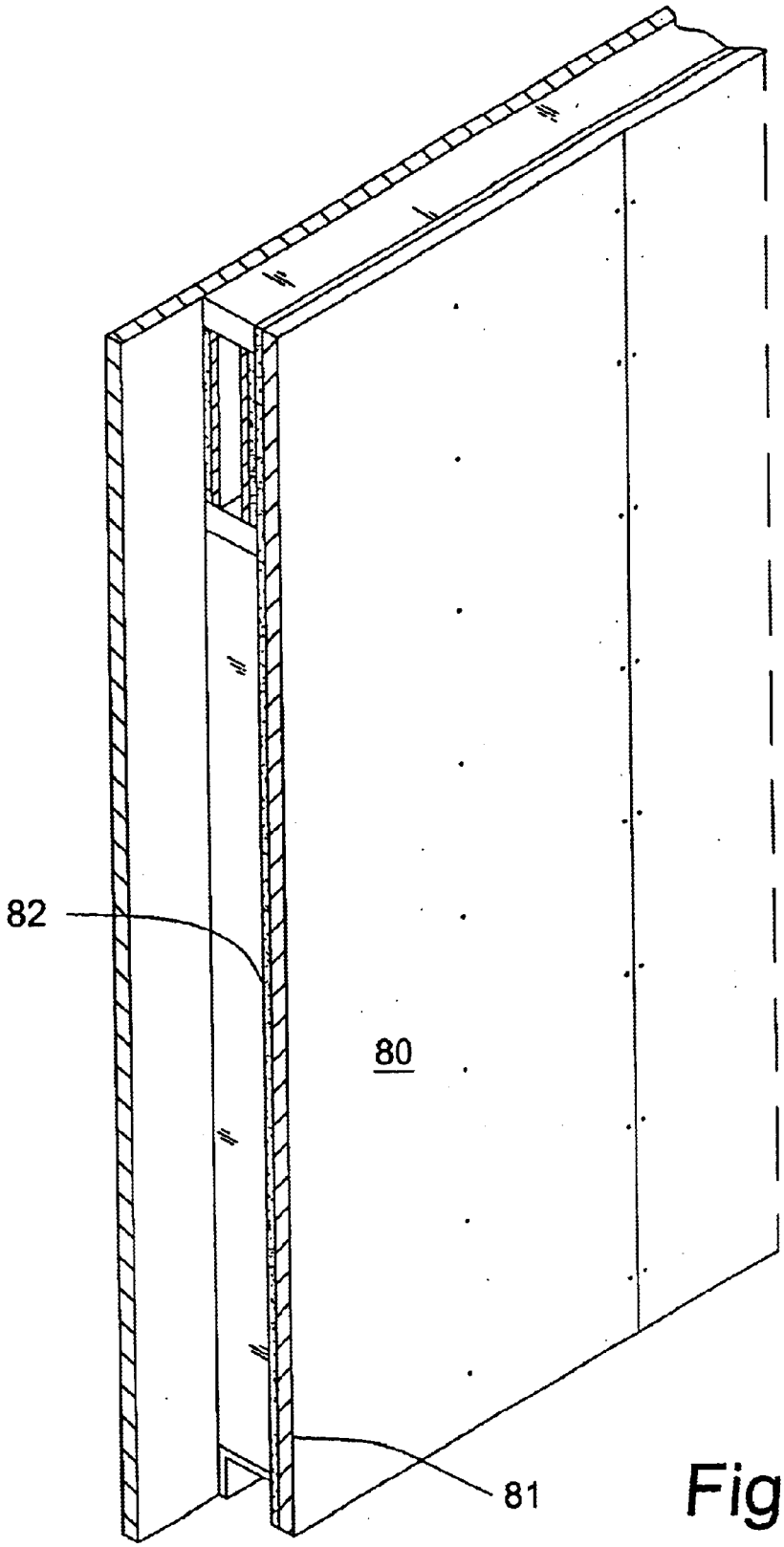
FIG. 6 is a perspective view of a finished wall panel according to FIG. 1.

As shown in FIGS. 5 and 6, when two adjacent wall panels 1, 1*a* are placed perpendicular to one another to form a corner 61, the nailing strip (shown removed) of a first wall panel 1*a* is removed. The remaining nailing strip 60 of a second wall panel 1 is affixed to the U-shaped cap 73 of the adjacent first wall panel 1*a* using mechanical fasteners 21 which penetrate the sheeting material 11 and the U-shaped cap 73 and embed into the insulation 70 of the adjacent panel 1*a*.

Preferably and having reference to FIG. 6, a layer of finishing material 80 such as drywall or paper, which acts as an air barrier and an aesthetic finishing, is affixed to an inner surface 81 of an interior layer 82 of the sheeting material 11. The finishing material 80 can be either mechanically fastened or can be adhesively bonded or laminated to the interior layer 82 of sheeting material 11 as the inner surface 81 of the wall panel 1 is not exposed to the elements.

In a preferred embodiment of the invention, the sheeting material 11 is oriented strand board (OSB) and the finishing material 80 is drywall.

Figure 7:
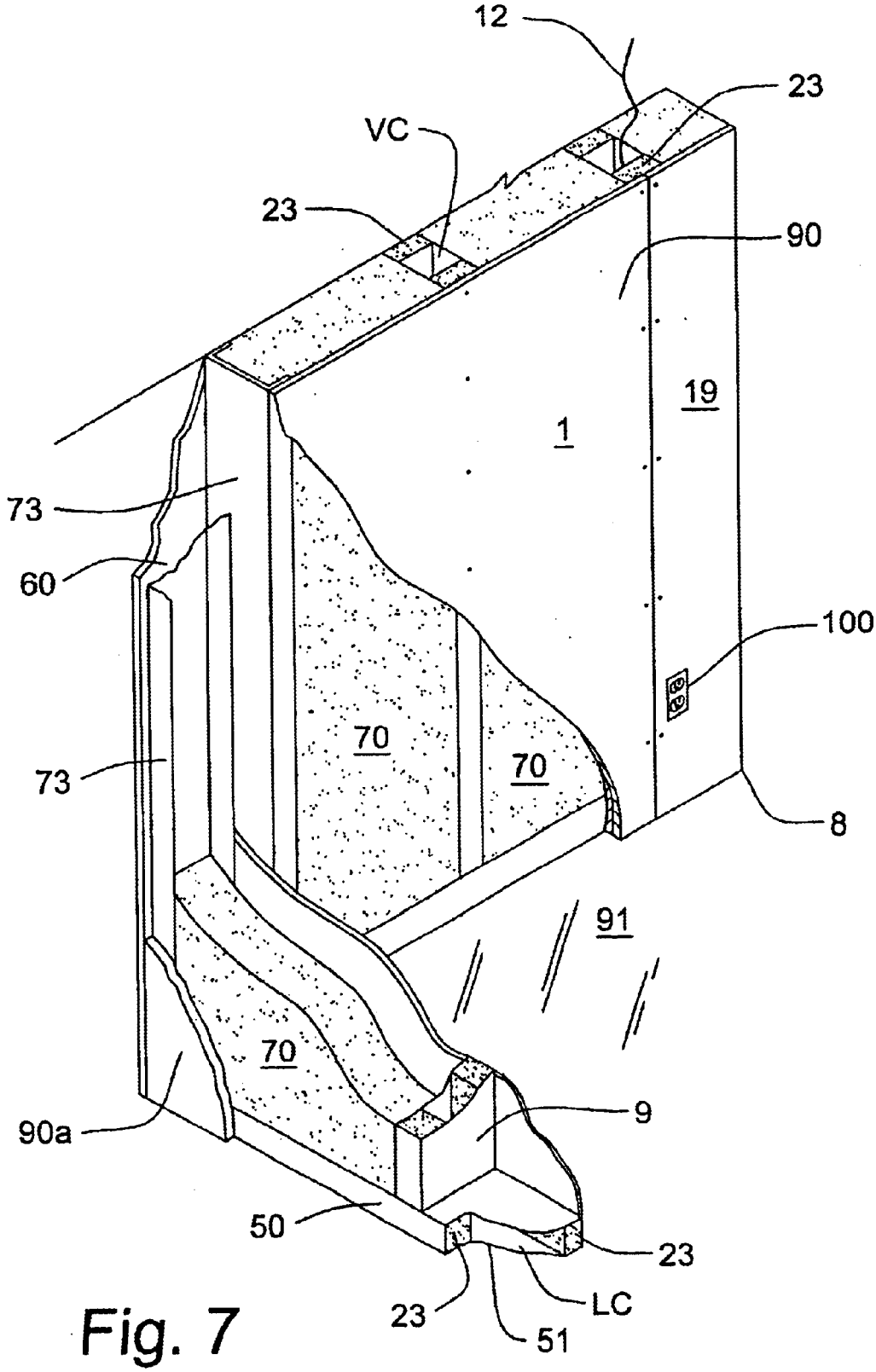
FIG. 7 is a partially cutaway perspective view of a corner of a structure constructed using wall panels of the present invention.

As shown in FIG. 7, an exterior load bearing wall 90 of a structure is formed using a plurality of adjacent composite wall panels 1, 1*a* of the present invention. Linear sections of base plate 51, fitted with protective barrier members 23 are affixed to a floor surface 91, such as concrete, using mechanical fasteners 21. Panels 1,1*a* . . . of the present invention, having U-shaped wall base fittings 50 attached to a bottom 8 are affixed over the base plates 51, as previously described, to form the exterior load bearing walls 90, 90*a* of the structure. Wiring for electrical, communications and the like 12, as shown in FIG. 1, are run through the upper and lower horizontal chases "UC" "LC" and holes 32 are drilled to access the vertical chases "VC", as required, to permit customizing of the locations of outlets 100 along the wall 90. Openings 16 are cut through the panels 1, below the header 5, to form windows and doors at desired locations and are finished in a conventional manner. The remainder of the structure, such as the roof, is completed using conventional construction techniques. A finishing is applied to the outer surface of the external layer 20 of sheeting material 11 as required. Such finishing may be a siding material, a concrete material, or another suitable finishing chosen to meet or exceed local building codes.

Figure 8:
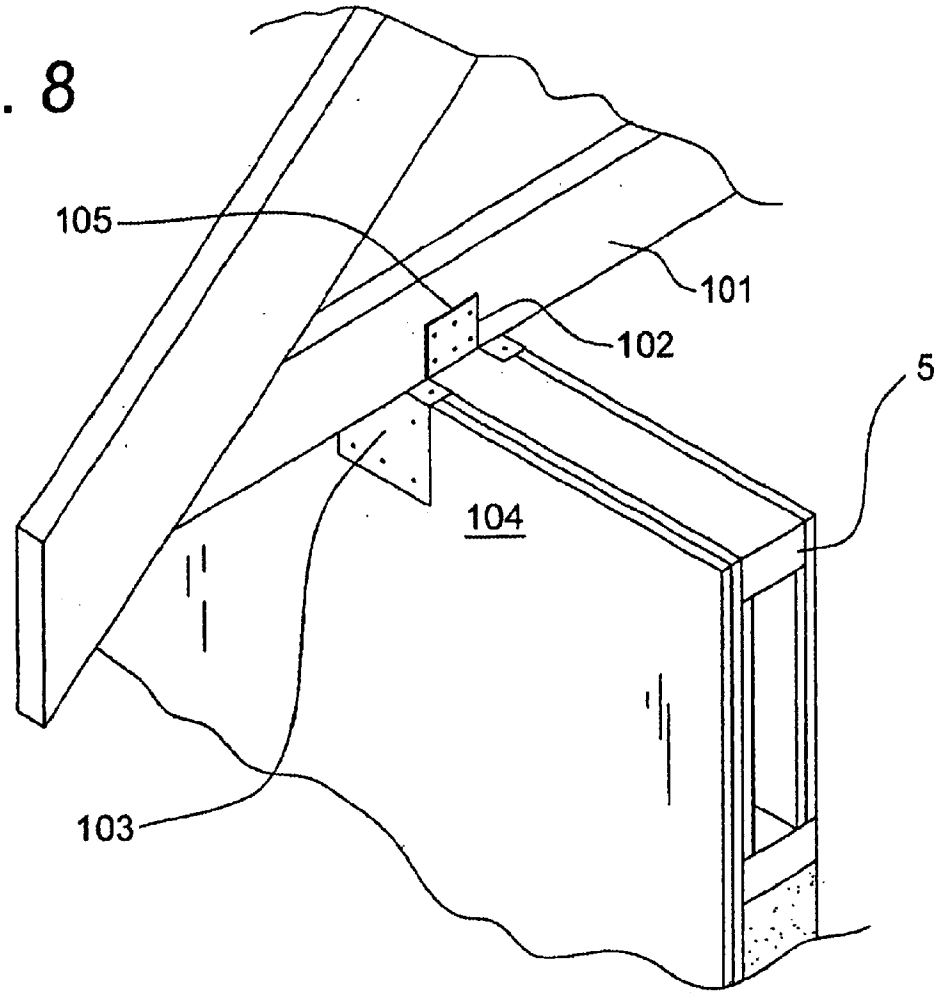
FIG. 8 is a perspective view of a structure according to FIG. 7 having roof trusses secured to resist wind loading.

Optionally, as shown in FIG. 8, for use in geographical areas that are prone to hurricanes, the header 5 may be constructed using laminated beams, such as beams formed of microlaminated material, in place of traditional wooden lumber and the roof trusses 101 may be joined to the header 5 using metal fasteners 102 that securely attach the truss 101 to the header 5 to reduce the danger of the roof structure lifting as a result of the high winds.

Preferably, the fastener 102 has a downward depending planar surface 103 that is affixed to a vertical surface 104 of the header 5 and a cradle 105 which supports the truss 101 and can be affixed to the truss 101 on opposing sides.

The embodiments of the invention in which an exclusive property or privilege is claimed are defined as follows:

1. A composite wall panel comprising:

a base extending horizontally at a bottom, of the panel and adapted for attachment to a floor structure;

a continuous hollow header extending horizontally at a top of the panel, the hollow header defining an upper horizontally extending chase for passage of services therethrough;

a plurality of vertically extending, hollow studs spaced at intervals intermediate a length of the panel so as to space the base from the header for forming a frame, the hollow studs defining a plurality of vertically extending chases for communication with the upper horizontally extending chase;

insulating material positioned intermediate the spaced studs; and opposing layers of sheeting material affixed to opposing surfaces of the frame, at least one of which is affixed to the studs using mechanical fasteners, wherein the vertically extending studs are fitted with protective barrier members to prevent protrusion of the mechanical fasteners into the vertically extending chases.

2. The panel as described in claim 1 wherein the at least one opposing layer of sheeting material affixed to the frame using mechanical fasteners is an external layer of sheeting material and the vertically extending chases are fitted with protective barrier members adjacent the external layer.

3. The panel as described in claim 1 wherein opposing layers of sheeting material are affixed to the frame using mechanical fasteners and the vertically extending chases are fitted with protective barrier members adjacent each layer.

4. The panel as described in claim 1 wherein the base is hollow, forming a lower horizontally extending chase for communication with the plurality of vertically extending chases.

5. The panel as described in claim 4 wherein the lower horizontally extending chase further comprises:

a downward facing U-shaped wall base fitting attached to a bottom of the frame adapted for fitting over a cooperating upward facing U-shaped base plate for forming a rectangular hollow chase.

6. The panel as described in claim 1 wherein the continuous hollow header further comprises continuous upper end lower rails held in parallel spaced relationship by horizontally extending and laterally opposing spacing members affixed therebetween forming a rectangular beam having a hollow core.

7. The composite panel as described in claim 6 wherein the opposing spacing members are oriented strand board.

8. The composite panel as described in claim 6 wherein the opposing spacing members further comprise a layer of rigid insulation affixed to outward facing surfaces of each of the opposing spacing members.

9. The composite panels as described in claim 1 wherein the studs are metal.

10. The composite panels as described in claim 9 wherein the metal studs further comprise two vertically extending interlocking shaped members defining a hollow chase therebetween.

11. The composite panel as described in claim 1 wherein the sheeting material is oriented strand board.

12. The composite panel as described in claim 1 wherein the insulating material is.

13. The composite panel as described in claim 12 wherein the rigid insulating material is polystyrene insulation.

14. The composite panel as described in claim 12 wherein the rigid insulating material is polyurethane.

15. The composite panel as described in claim 1 further comprising a layer of finishing material affixed to an inner surface of an interior layer of sheeting material.

16. The composite panel as described in claim 15 wherein the layer of finishing material is drywall.

17. The composite panel as described in claim 16 wherein the drywall is mechanically affixed to an inner surface of an interior layer of sheeting material.

18. The composite panel as described in claim 16 wherein the drywall is adhesively bonded to an inner surface of an interior layer of sheeting material.

19. The composite panel as described in claim 15 wherein the layer of finishing material is paper adhesively bonded to an inner surface of an interior layer of sheeting material.

20. A load bearing wall structure constructed using a plurality of composite wall panels of claim 1.

21. The load bearing wall structure as described in claim 20 wherein ends of the panel further comprise vertically extending U-shaped cap members positioned about ends of the insulating material so as to sandwich the insulating material between the U-shaped cap member and an adjacent stud.

22. The load bearing wall structure as described in claim 21 wherein an external layer of a sheeting material extends beyond a width of the panel for forming a nailing strip.

23. The load bearing wall structure as described in claim 22 further comprising:

at least first and second panels positioned perpendicular to one another for forming a corner wherein the nailing strip the first panel is removed so that the nailing strip of the second panel can be affixed to an end of the first panel.

24. The load bearing wall structure as described in claim 23 wherein the base further comprises a downward facing U-shaped wall base fitting attached to a bottom of the panel for cooperating with an upward facing U-shaped base plate adapted to be attached to a floor structure.

* * * * *